US009395655B2

(12) United States Patent
Tetsuno et al.

(10) Patent No.: US 9,395,655 B2
(45) Date of Patent: Jul. 19, 2016

(54) IMAGE FORMING APPARATUS

(71) Applicant: CANON KABUSHIKI KAISHA, Tokyo (JP)

(72) Inventors: Shuichi Tetsuno, Kawasaki (JP); Shinji Katagiri, Yokohama (JP); Masaru Ohno, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/962,054

(22) Filed: Dec. 8, 2015

(65) Prior Publication Data

US 2016/0170335 A1 Jun. 16, 2016

(30) Foreign Application Priority Data

Dec. 10, 2014 (JP) ..... 2014-250403

(51) Int. Cl.
*G03G 15/16* (2006.01)

(52) U.S. Cl.
CPC ..... *G03G 15/1605* (2013.01)

(58) Field of Classification Search
CPC ..... G03G 15/1605; G03G 15/165; G03G 15/1655; G03G 15/1695; G03G 15/1665
USPC ..... 399/316
See application file for complete search history.

(56) References Cited

U.S. PATENT DOCUMENTS 4,491,407 A * 1/1985 Mitsuyama ..... G03G 15/165 399/316
4,933,723 A * 6/1990 Kakuta ..... G03G 15/165 271/107
5,268,724 A * 12/1993 Koizumi ..... G03G 15/165 271/251
5,812,920 A * 9/1998 Mizude ..... G03G 15/165 399/316
6,125,244 A * 9/2000 Kamiya ..... G03G 15/6558 399/388
6,701,119 B2 * 3/2004 Tomiki ..... G03G 15/6558 399/316

FOREIGN PATENT DOCUMENTS

JP H0744032 A 2/1995
JP 2000338795 A 12/2000
JP 2001139185 A 5/2001

* cited by examiner

*Primary Examiner* — Billy Lactaoen
(74) *Attorney, Agent, or Firm* — Canon U.S.A., Inc. IP Division

(57) ABSTRACT

An image forming apparatus includes a resistor in a sheet shape configured to ground a sensor member electrically; a first contact member configured to form a current path between the resistor and the sensor member; and a second contact member configured to form a current path between the resistor and an electrical ground portion. A first contact portion and a second contact portion are arranged so as not to overlap in a thickness direction of the resistor.

11 Claims, 9 Drawing Sheets

FIG. 6

| CONFIGURATION | HIGH-HUMIDITY ENVIRONMENT | | LOW-HUMIDITY ENVIRONMENT | |
|---|---|---|---|---|
| | LEAK CURRENT (μA) | TRANSFER DEFECT | POTENTIAL (V) | NOISE |
| EMBODIMENT 1 | 0.19 | ○ | −170 | NONE |
| EMBODIMENT 2 | 0.21 | ○ | −180 | NONE |
| EMBODIMENT 3 | 0.17 | ○ | −130 | NONE |
| EMBODIMENT 4 | 0.2 | ○ | −160 | NONE |
| COMPARATIVE EXAMPLE 1 | 60 | × | 0 | NONE |
| COMPARATIVE EXAMPLE 2 | 56 | × | 0 | NONE |
| COMPARATIVE EXAMPLE 3 | 10 | × | 0 | NONE |
| COMPARATIVE EXAMPLE 4 | 2 | △ | 0 | NONE |
| COMPARATIVE EXAMPLE 5 | 0.7 | ○ | −110 | NONE |
| COMPARATIVE EXAMPLE 6 | 0.1 | ○ | −280 | NONE |
| COMPARATIVE EXAMPLE 7 | 0.01 | ○ | −1600 | PRESENT |
| COMPARATIVE EXAMPLE 8 | 0 | ○ | −3200 | PRESENT |

IMAGE FORMING APPARATUS

BACKGROUND OF THE INVENTION

1. Field of the Invention

The present invention relates to an image forming apparatus that performs image formation by an electrophotographic method, such as a copying machine, a printer, a facsimile apparatus, or a multifunction peripheral.

2. Description of the Related Art

In an electrophotographic image forming apparatus, a toner image is electrostatically transferred onto a transfer material by applying voltage having a polarity opposite to that of toner to a transfer member that is arranged so as to face a photosensitive drum and an intermediate transfer body serving as image bearing members. Then, the toner image is fixed onto the transfer material by heat and pressure at a fixing unit.

The transfer material is conveyed from a sheet supplying cassette to a transfer unit and a fixing unit sequentially by a conveying roller and a conveying belt and is adjusted to be conveyed properly by a conveyance guide and a sensor, which are arranged in a conveying path.

A conveyance member such as the conveying roller, the conveying belt, the conveyance guide, or the sensor is charged when making contact with the transfer material and easily discharges electricity to the transfer material or other members particularly under a low-humidity environment. When the discharging occurs, image defect for the transfer material and operation failure of the image forming apparatus due to noise are caused in some cases. Thus, a configuration is known in which the conveyance member is a conductive conveyance member and electrically grounded, and thus charges in the conductive conveyance member are released to the ground and charging of the conductive conveyance member is suppressed.

When the conductive conveyance member is grounded, however, particularly under a high-humidity environment, transfer current is likely to leak from a transfer unit to the conductive conveyance member through a surface direction of the transfer material. Thus, Japanese Patent Laid-Open No. 2001-139185 discloses a configuration in which a conveyance guide is grounded through a resistor to thereby suppress leakage of transfer current to a conductive conveyance member.

However, with the configuration for grounding through the conductive conveyance member as Japanese Patent Laid-Open No. 2001-139185, it is difficult to suppress overcharging of the conductive conveyance member when resistance of the resistor is excessively high and to suppress leakage of the transfer current to the conveyance member when the resistance of the resistor is excessively low. Therefore, it is difficult to simultaneously suppress the charging of the conveyance member and the leakage of the transfer current.

SUMMARY OF THE INVENTION

Thus, the invention provides an image forming apparatus capable of simultaneously suppressing occurrence of overcharging of a conductive conveyance member and leakage of transfer current.

In order to solve the aforementioned problem, provided is an image forming apparatus including: an image bearing member configured to bear a toner image thereon; a transfer member configured to form a transfer unit with the image bearing member; a voltage supply device configured to transfer a toner image on the image bearing member electrostatically onto a transfer material at the transfer unit by applying voltage to the transfer member; a conductive conveyance member configured to have conductivity and make contact with the transfer material that is conveyed toward the transfer unit; a resistor in a sheet shape configured to ground the conductive conveyance member electrically; a first contact member configured to form a current path between the resistor and the conductive conveyance member; and a second contact member configured to form a current path between the resistor and an electrical ground portion, in which, a first contact portion between the resistor and the first contact member and a second contact portion between the resistor and the second contact member are arranged so as not to overlap in a thickness direction of the resistor.

Further features of the present invention will become apparent from the following description of exemplary embodiments with reference to the attached drawings.

BRIEF DESCRIPTION OF THE DRAWINGS

FIG. 6 is a table illustrating effect confirmation results of Embodiments 1 to 3 and comparative examples 1 to 8.

DESCRIPTION OF THE EMBODIMENTS

Embodiments of the invention are exemplarily described below in detail with reference to the drawings. It is to be noted that the dimensions, materials, shapes, and relative arrangements of components described in the following embodiments should be properly changed depending on configurations of an apparatus to which the invention is applied and various conditions. Hence, unless otherwise particularly noted, it is not intended to limit the scope of the invention only to the embodiments.

Embodiment 1

Figure 1:
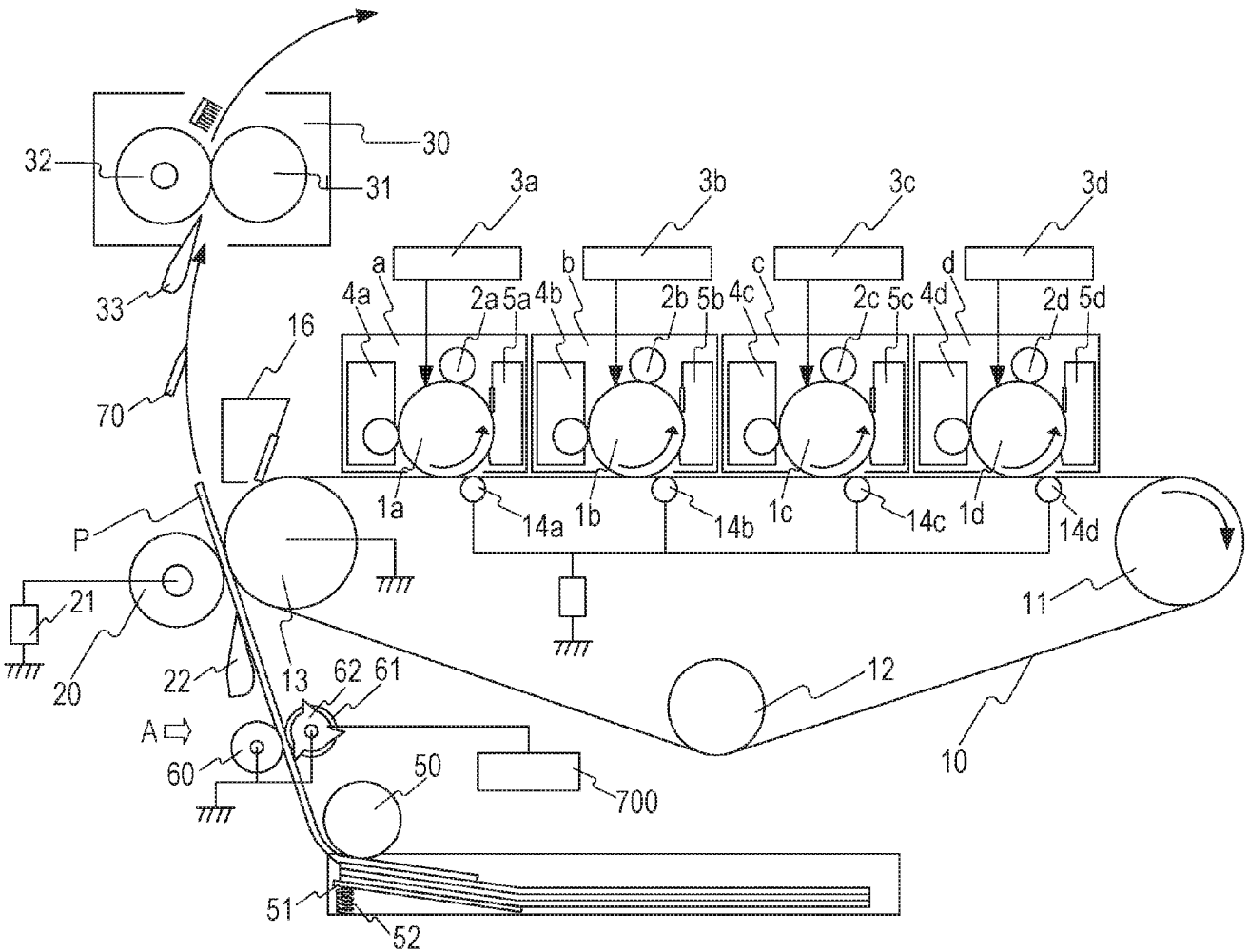
FIG. 1 is a diagram illustrating an image forming apparatus of Embodiment 1.

FIG. 1 is a schematic diagram illustrating one example of an image forming apparatus. The image forming apparatus is capable of forming an image on a transfer material such as a recording sheet or an OHP sheet by an electrophotographic method according to signals transmitted from an external appliance, such as a personal computer connected to the image forming apparatus so as to allow communication therebetween.

A configuration and operations of the image forming apparatus of the present embodiment will be described with reference to FIG. 1. The image forming apparatus of the present embodiment is a so-called tandem printer that includes image forming stations a to d. Images of respective colors are formed in such a manner that a first image forming station a forms a yellow (Y) image, a second image forming station b forms a magenta (M) image, a third image forming station c forms a cyan (C) image, and a fourth image forming station d forms a black (Bk) image. Configurations of the image forming stations are the same, except for the colors of toners accommodated therein. The following description will be given by using the first image forming station a.

The image forming station a includes a drum-shaped electrophotographic photosensitive member (hereinafter, referred to as a photosensitive drum) la, a charging roller 2*a* serving as a charging member, a developing unit 4*a*, and a cleaning device 5*a*. The photosensitive drum 1*a* is an image bearing member that is rotationally driven at a predetermined circumferential velocity (processing speed) in an arrow direction and bears a toner image.

The developing unit 4*a* is a device that contains yellow toner and develops the yellow toner on the photosensitive drum 1*a*. The cleaning device 5*a* is a member for collecting toner adhering to the photosensitive drum 1*a*. The cleaning device 5*a* includes a cleaning blade serving as a cleaning member in contact with the photosensitive drum 1*a*, and a waste toner box that contains toner collected by the cleaning blade.

When a control unit 700 such as a controller receives an image signal, an image forming operation is started and the photosensitive drum 1*a* is rotationally driven. During the rotation, the photosensitive drum 1*a* is uniformly charged by the charging roller 2*a* with a predetermined polarity (negative polarity in the present embodiment) at a predetermined potential, and is exposed to light by an exposure unit 3*a* in accordance with the image signal. Thus, an electrostatic latent image which corresponds to a yellow color component image of an intended color image is formed. Next, the electrostatic latent image is developed at a developing position by the developing unit (yellow developing unit) 4*a* and visualized as a yellow toner image. A normal charging polarity of toner contained in the developing unit is a negative polarity.

An intermediate transfer belt 10 is an endless belt having a circumferential length of 700 mm, an axial direction length of 240 mm, and thickness of 0.1 mm formed by using polyimide to which carbon is added. A resistance value of the transfer belt 10 used in the present embodiment is $1\times10^6$ Ω·m as a volume resistivity. The volume resistivity is measured by using Hiresta-UP (MCP-HT450) manufactured by Mitsubishi Chemical Corporation using a ring probe type UR (mode number: MCP-HTP12). The measurement was performed for 10 seconds by setting a room temperature as 23° C. and a room humidity as 50%, under a condition with an applied voltage of 100 V.

The intermediate transfer belt 10 serving as an image bearing member is stretched by a plurality of stretching members 11, 12, and 13, and rotationally driven at substantially the same circumferential velocity as that of the photosensitive drum 1*a* in the same direction as a movement direction of the photosensitive drum 1*a* at a facing portion in contact with the photosensitive drum 1*a*. In a process of passing through a contact portion (hereinafter, referred to as a primary transfer portion) between the photosensitive drum 1*a* and the intermediate transfer belt 10, the yellow toner image formed on the photosensitive drum 1*a* is transferred (primary-transferred) onto the intermediate transfer belt 10. Primary transfer-residual toner remaining on a surface of the photosensitive drum 1*a* is cleaned and removed by the cleaning device 5*a* and then is provided for a charging and subsequent image forming process.

Likewise, a magenta (second color) toner image, a cyan (third color) toner image, and a black (fourth color) toner image are respectively formed by the second, third, and fourth image forming stations b, c, and d, and sequentially transferred to be superimposed onto the intermediate transfer belt 10, so that a composite color image is obtained.

In a process of passing through a secondary transfer portion formed by the intermediate transfer belt 10 and a secondary transfer roller 20 serving as a transfer member, the toner images of the four colors on the intermediate transfer belt 10 are electrostatically transferred (secondary-transferred) onto the transfer material conveyed to the secondary transfer portion.

The secondary transfer roller 20 makes contact with an outer peripheral surface of the intermediate transfer belt 10 with a pressure of 50 N and forms the secondary transfer portion. The secondary transfer roller 20 is rotated by the movement of the intermediate transfer belt 10, and a transfer material P is pinched and conveyed by the secondary transfer portion.

A transfer power supply 21 is connected to the secondary transfer roller 20 and supplies voltage output from a transformer (not illustrated) to the secondary transfer roller 20. A CPU (not illustrated) serving as a control IC of the image forming apparatus controls the voltage (secondary transfer voltage) supplied to the secondary transfer roller 20 to be substantially constant in such a manner that a difference between a target voltage which is set in advance and a detection voltage which is an actual output value is fed back to the transformer. The transfer power supply 21 is capable of outputting voltage ranging from 100 [V] to 4000 [V].

The transfer material P is kept in a sheet supplying cassette before image formation, and when an operation of the image formation starts, a sheet supplying metal plate 51 which is pressed by a spring 52 serving as an urging member presses transfer materials in the sheet supplying cassette against a pick-up roller 50. When the pick-up roller 50 rotates in that state, the transfer materials are picked up one by one and fed to a conveyance nip portion formed by a conveying roller 60 and a conveyance idler roller 61.

The transfer material P fed to the conveyance nip portion is pinched and conveyed at the conveyance nip portion to the secondary transfer portion. Sensor members 62 are arranged at both sides in an axial direction of the conveyance idler roller 61 and detect whether or not the transfer material P is present at the conveyance nip portion. The control unit 700 determines timing of each image formation operation based on a detection result as to whether or not the transfer material P is present at the conveyance nip portion.

A conveyance guide 22 serving as a first conveyance member is arranged upstream of the secondary transfer portion. The conveyance guide 22 makes contact with the transfer material P conveyed to the secondary transfer portion by the conveying roller 60 and regulates the conveyance of the transfer material P to thereby introduce the transfer material P to a secondary transfer nip portion reliably. The conveyance guide 22 is formed of conductive resin and is grounded through a path (not illustrated).

After the secondary transfer ends, the transfer material P bearing the toner images of the four colors thereon is conveyed to a fixing nip portion 30 formed of a fixing roller 31 and a pressure roller 32, where the transfer material P is heated and pressed so that toner of the four colors are fused and mixed and then fixed to the transfer material P. The fixing roller 31 uses a roller with an outer diameter of 18 mm, which is obtained by forming an elastic layer made of insulating silicone rubber on a metal pipe and further covering an outer periphery of the elastic layer with an insulating PFA tube, and incorporates a halogen heater (not illustrated) as a heat unit. The halogen heater generates heat when voltage is supplied from a power supply (not illustrated) in a noncontact manner with the fixing roller 31. The pressure roller 32 is a roller with an outer diameter of 18 mm, which is obtained by forming an elastic layer made of conductive silicone rubber on a metal core and further covering an outer periphery of the elastic layer with a conductive PFA tube, and is grounded through a path (not illustrated) from the metal core. The fixing roller 31 and the pressure roller 32 are pressed with 10 kg to form the fixing nip portion 30. The pressure roller 32 is rotationally driven by a motor (not illustrated), and the fixing roller 31 is rotated in accordance with the rotation of the pressure roller 32, so that the transfer material P is pinched and conveyed at the fixing nip portion 30.

A conveyance guide 33 serving as a second conveyance member is arranged upstream of the fixing nip portion 30. The conveyance guide 33 makes contact with the transfer material P conveyed to the fixing nip portion 30 by the conveying roller 60 and regulates the conveyance of the transfer material P to thereby introduce the transfer material P to the fixing nip portion 30 reliably. The conveyance guide 33 is formed of conductive resin and is grounded through a path (not illustrated).

Toner which remains on the intermediate transfer belt 10 after the secondary transfer is cleaned and removed by a cleaning device 16. The cleaning device 16 includes a cleaning blade serving as a cleaning member in contact with the intermediate transfer belt 10, and a waste toner box that contains toner collected by the cleaning blade. A full-color print image is thus formed by the operation described above.

Figure 2:
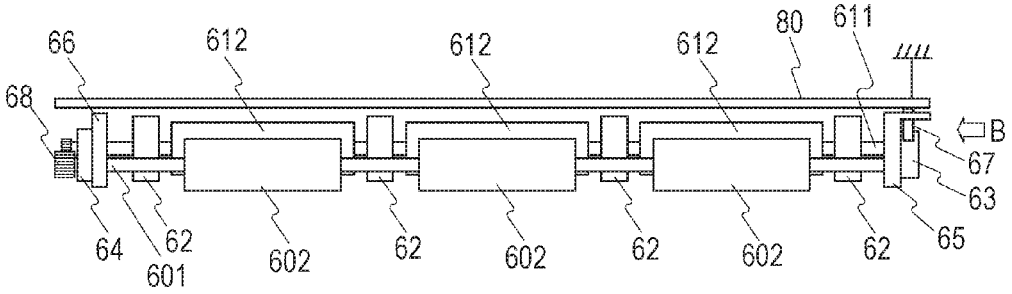
FIG. 2 is a diagram illustrating a conveyance nip portion of Embodiment 1.

Next, the conveyance nip portion of the present embodiment will be described in detail. FIG. 2 illustrates the conveyance nip portion as viewed from a direction A of FIG. 1. As illustrated in FIG. 2, the conveying roller 60 is formed with an elastic layer made of conductive rubber 602 on a metal core 601, in which the conductive rubber 602 is divided into three portions in the axial direction. A conveyance idler roller 612 is a conductive idler roller that is made of conductive POM as a material, and is held at a position facing the conductive rubber 602 so as to rotate freely by a metal core 611. The conveying roller 60 is rotationally driven by a motor (not illustrated) through a gear unit 68, and the conveyance idler roller 612 is rotated along with the rotation of the conveying roller 60. The sensor members 62 formed of conductive POM are held by the metal core 611 at both sides in the axial direction of the conveyance idler roller 612 and the sensor members 62 rotate with the metal core 611.

The metal core 601 and the metal core 611 have one end held by a conductive bearing 63 and another end held by an insulating bearing 64, and the conductive bearing 63 and the insulating bearing 64 are held by an insulating frame 65 and an insulating frame 66, respectively. The insulating frame 65 and the insulating frame 66 are fixed to a main body frame 80 of the image forming apparatus at portions not illustrated. Conductive POM is used as a material of the conductive bearing 63, and insulating PC-ABS is used as materials of the insulating bearing 64, the insulating frame 65, and the insulating frame 66.

A resistance member 67 is disposed between the conductive bearing 63 and the main body frame 80. The conveying roller 60, the conveyance idler roller 61, and the sensor members 62 are configured so as to be electrically grounded through the conductive bearing 63, the resistance member 67, and the main body frame 80, respectively from the metal core 601 or the metal core 611. The conveying roller 60, the conveyance idler roller 61, and the sensor members 62 are conductive conveyance members having conductivity.

The sensor members 62 are sensor members that make contact with the transfer material P at the conveyance nip portion to detect timing when a leading edge of the transfer material P enters the conveyance nip portion and timing when a trailing edge of the transfer material P is discharged from the conveyance nip portion.

FIGS. 3A to 3F each illustrate a vicinity of the conveyance nip portion in FIG. 1 in an enlarged manner. As illustrated in FIGS. 3A to 3F, the sensor member 62 has contact portions 621, 622, and 623 as areas of contact with the transfer material.

FIGS. 3A to 3F illustrate operations of the sensor member 62 from immediately before the same transfer material P enters the conveyance nip portion until being discharged therefrom. In FIGS. 3A to 3F, a linear arrow indicates a conveyance direction of the transfer material P and a curved arrow indicates a rotation direction of the sensor member 62. The operations of the sensor member 62 will be described below with reference to FIGS. 3A to 3F.

Figure 3A:
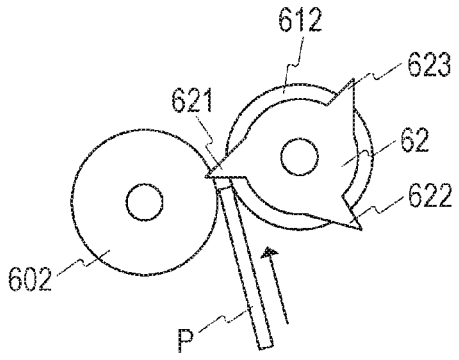
FIGS. 3A to 3F are diagrams illustrating a sensor member of Embodiment 1.
Figure 3B:
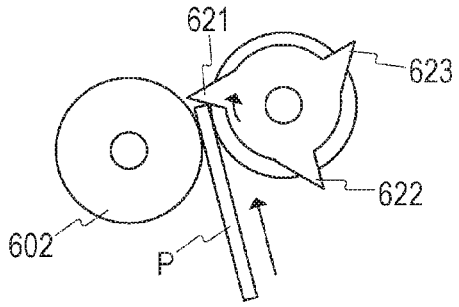

As illustrated in FIG. 3A, before the transfer material P enters the conveyance nip portion, the sensor member 62 remains still in a state where the contact portion 621 with the transfer material P is positioned at the conveyance nip portion. Then, when the leading edge of the transfer material P enters the conveyance nip portion as illustrated in FIG. 3B, the leading edge of the transfer material P pushes the contact portion 621 and thus the sensor member 62 rotates in an arrow direction, so that the contact portion 621 moves from the conveyance nip portion. A detection unit (not illustrated) detects that the contact portion 621 has moved from the conveyance nip portion, and timing of the detection is stored in the control unit 700 as the timing when the transfer material P has entered the conveyance nip portion.

Figure 3C:
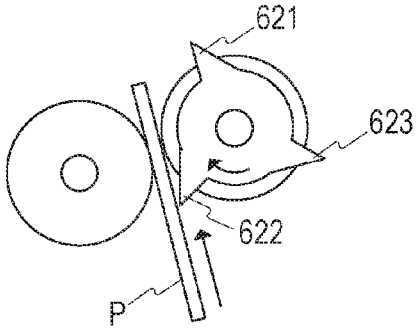

When the contact portion 621 moves from the conveyance nip portion, a mechanism (not illustrated) tries to rotate the sensor member 62 so that the contact portion 622 reaches the conveyance nip portion. Thus, as illustrated in FIG. 3C, while the transfer material P is being pinched and conveyed by the conveyance nip portion, the contact portion 622 that has been rotationally moved by the mechanism not illustrated presses the transfer material P so that the contact portion 622 and the transfer material P slide.

Figure 3D:
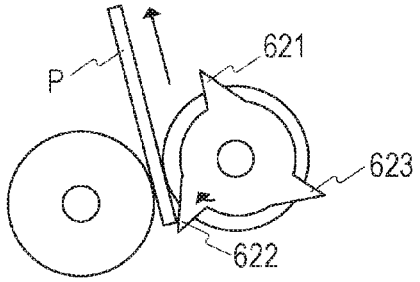

Then, as illustrated in FIG. 3D, immediately before the trailing edge of the transfer material P passes through the conveyance nip portion, the contact portion 622 of the sensor member 62 rotationally moves to the conveyance nip portion so as to follow the trailing edge of the transfer material P.

Figure 3E:
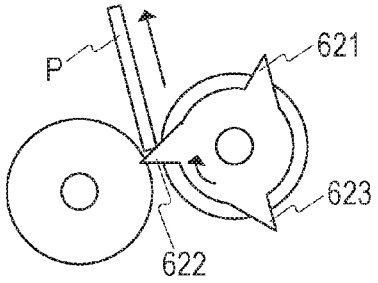

After that, at substantially the same time as when the trailing edge of the transfer material P passes through the conveyance nip portion as illustrated in FIG. 3E, the contact portion 622 reaches the conveyance nip portion. A detection unit (not illustrated) detects that the contact portion 622 has reached the conveyance nip portion, and timing of the detection is stored in the control unit 700 as the timing when the transfer material P has been discharged from the conveyance nip portion.

Figure 3F:
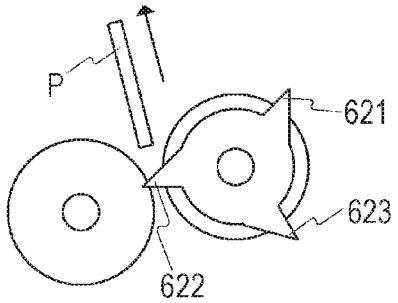

After the transfer material P is discharged from the conveyance nip portion, the sensor member 62 remains still in a state where the contact portion 622 is positioned at the conveyance nip portion as illustrated in FIG. 3F. When a next transfer material P is fed to the conveyance nip portion, operations in FIGS. 3A to 3F described above are carried out similarly.

The conveying roller 60, the conveyance idler roller 61, and the sensor member 62 are grounded as described above in the present embodiment. This is intended for preventing contact charging between the transfer material P and the sensor member 62, because, in particular, the sensor member 62 slides on the transfer material P which is being conveyed and thus is easily charged.

The sensor member 62 is grounded through the resistance member 67. This is intended for suppressing leakage of secondary transfer current from the secondary transfer portion to the sensor member 62, the conveying roller 60, and the conveyance idler roller 61, which are conductive conveyance members, through a surface direction of the transfer material P.

When resistance of the resistance member 67 is excessively high, however, charges of the sensor member 62 are not allowed to be released to the ground (ground portion), thus it is difficult for contact charging between the transfer material P and the sensor member 62 to be suppressed. When the resistance of the resistance member 67 is excessively low to the contrary, it is difficult to suppress the leakage of the secondary transfer current from the secondary transfer portion to the sensor member 62 through the surface direction of the transfer material P.

Accordingly, for simultaneously suppressing the charging of the sensor member 62 by contact with the transfer material P and the leakage of the secondary transfer current to the sensor member 62 through the transfer material P, a resistor having high resistance and a limited resistance region needs to be used as the resistance member 67. When a resistance unit having high resistance is used as the resistor, the resistance unit is expensive and large in size and wiring and a substrate are required to attach a resistance element, so that usage of the resistance unit as the resistor having high resistance is likely to hinder reduction in costs and size of the image forming apparatus.

Figure 4A:
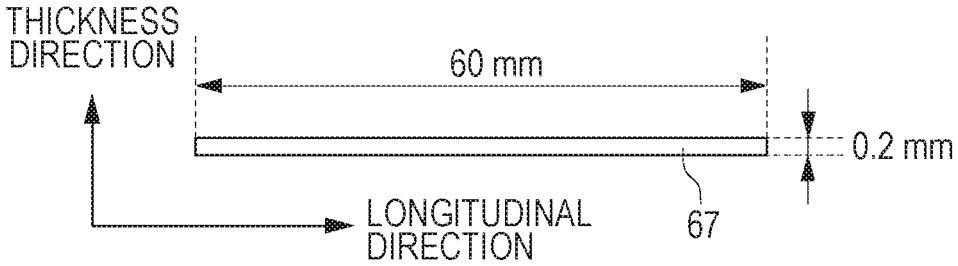
FIGS. 4A and 4B are diagrams illustrating a resistance member of Embodiment 1.
Figure 4B:
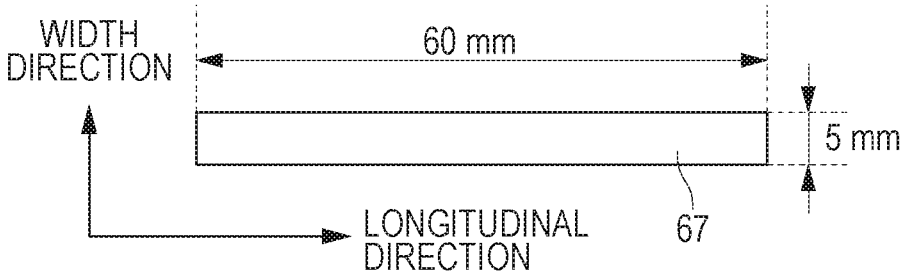

Thus, a resistor in a sheet shape is used as the resistance member 67 in the present embodiment. FIGS. 4A and 4B illustrate the shape of the resistance member 67. The resistance member 67 is a sheet-shaped resistor having a rectangular shape, and has a length in a longitudinal direction of 60 mm, a length in a transverse direction (width direction) of 5 mm, and thickness of 0.1 mm. A material of the resistance member 67 is conductive resin obtained by adding carbon to polyimide which is also used for the intermediate transfer belt 10, whose volume resistivity is $1.0\times10^{-6}$ Ω·m.

Figure 5A:
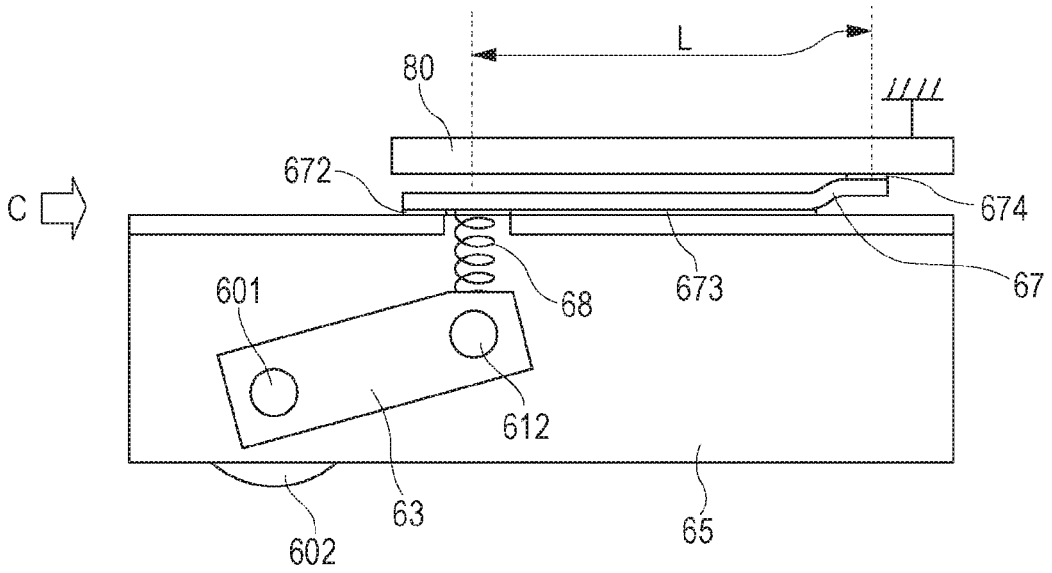
FIGS. 5A and 5B are diagrams illustrating a ground configuration of a conveyance member of Embodiment 1.
Figure 5B:
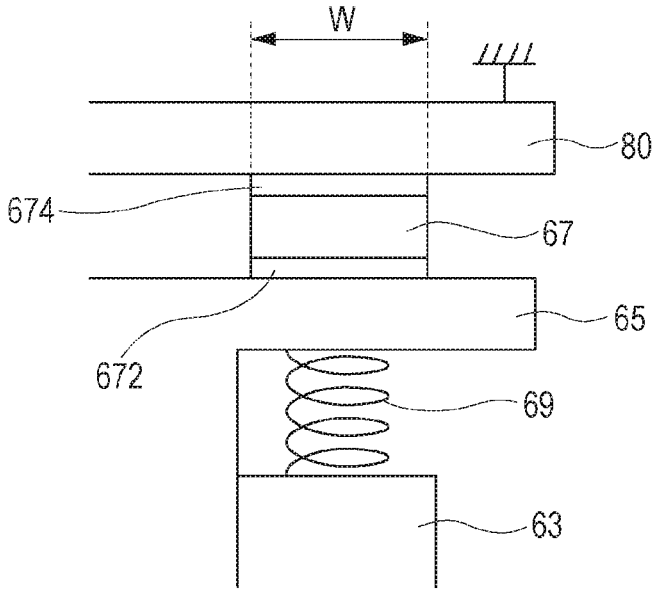

A first contact portion serving as a contact portion with the sensor member 62 is formed at one end of the resistance member 67 in the longitudinal direction and a second contact portion serving as a contact portion on the ground side is provided at the other end thereof. FIGS. 5A and 5B illustrate a ground configuration of the resistance member 67, in which FIG. 5A is an enlarged diagram of FIG. 2 as viewed from a direction B, and FIG. 5B is a diagram as viewed from a direction C of FIG. 5A. As illustrated in FIGS. 5A and 5B, the resistance member 67 is arranged between the insulating frame 65 and the main body frame 80 and is adhered to the insulating frame 65 with insulating two-sided adhesive tapes 672 and 673. A metal spring member 68 is disposed between the conductive bearing 63 and the resistance member 67 as a first contact member on the sensor member 62 side.

The end of the sensor member 67 in the longitudinal direction, to which the spring member 68 is pressed, serves as a contact on the conveyance member side of the resistance member 67. The spring member 68 serving as the first contact member also serves as a first contact member for forming a current path between the resistance member 67 and the sensor member 62.

The other end on the side opposite to the first contact portion of the resistance member 67 is adhered to the main body frame 80, which is a second contact member on the ground side, with a conductive two-sided adhesive tape 674, and the adhered portion serves as the second contact portion on the ground side of the resistance member 67. The main body frame 80 serving as the second contact member also serves as a second contact member for forming a current path between the resistance member 67 and the sensor member 62.

Accordingly, the sensor member 62 is configured to be grounded through the longitudinal direction of the resistance member 67. L indicated in FIG. 5A denotes a length of a conductive path between the contacts of the conveyance member side and the ground side on the resistance member 67. W indicated in FIG. 5B denotes a width of the conductive path between the contacts on the conveyance member side and the ground side of the resistance member 67.

Usage of the sheet-shaped resistor as the resistance member 67 allows the resistance member 67 to be arranged in a narrow space and to be deformed and arranged in accordance with the shape of a place where the resistance member 67 is arranged, for the thickness direction of the resistance member 67. This makes it possible to save a space for the resistance member 67 to be arranged. The sheet shape of the resistance member 67 allows the contacts between the resistance member 67 and the contact members to be taken with a simple configuration. For example, the contacts are able to be taken by adhering the resistance member 67 to the contact members with the adhesive tapes or pressing the resistance member 67 by the spring member serving as the contact member, like the present embodiment.

As will be explained in an exemplary example described below, it is possible to pinch the resistance member 67 between a back-up member and the contact member or to fasten the resistance member 67 by a screw member 671 together with the contact member. It is possible to take the contacts also by pressing the resistance member 67 against the contact member with stress caused by bending the resistance member 67.

The sheet shape of the resistance member 67 allows the resistance member 67 to be manufactured reliably with low costs. For example, the resistance member 67 may be manufactured by punching out a large sheet-shaped conductive resin or by coating a sheet-shaped base material with a conductive resin.

Next, effects achieved by providing the first contact portion at the one end of the resistance member 67 in the longitudinal direction and the second contact portion at the other end will be described.

Resistance between the contacts on the conveyance member side and the ground side of the resistance member 67 is calculated by "volume resistivity of the resistance member 67"×"width W of the conductive path between the contacts"× "thickness T of the conductive path between the contacts"/ "length L of the conductive path between the contacts". Thus, as the "width W of the conductive path between the contacts" and the "thickness T of the conductive path between the contacts" are small and as the "length L of the conductive path between the contacts" is large, the resistance between the contacts on the conveyance member side and the ground side of the resistance member 67 becomes high.

In the present embodiment, by providing the first contact portion, which is on the sensor member 62 side, at one end of the resistance member 67 in the longitudinal direction and providing the second contact portion, which is on the ground side, at the other end of the resistance member 67 in the longitudinal direction, the "length L of the conductive path between the contacts" is a length of the resistance member 67 in the longitudinal direction. Thereby, the "width W of the conductive path between the contacts" is the length of the resistance member 67 in the transverse direction, and the "length L of the conductive path between the contacts" is able to be made large and the "width W of the conductive path between the contacts" is able to be small. The resistance member 67 having a sheet shape allows the "thickness T of the conductive path between the contacts" to be small.

Thus, even when the volume resistivity of the conductive resin serving as the material of the resistance member 67 is not high, it is possible to make the resistance between the contacts on the conveyance member side and the ground side of the resistance member 67 sufficiently high.

The following experiments were carried out for confirming the effects of the present embodiment.

After the image forming apparatus and the transfer material P were left under a high-temperature and high-humidity environment of 30° C. and 80% for twenty four hours, a secondary color solid image was printed, and then, leak current of the secondary transfer current to the conductive member and transfer defect of the printed image were checked. Plain paper having basis weight of 75 g/m$^3$ was used as the transfer material P.

Further, after the image forming apparatus and the transfer material P were left under a low-temperature and low-humidity environment of 15° C. and 10% for twenty four hours, a monochromatic halftone image of 100 sheets were successively printed, and whether or not noise caused by discharging from the charged conveyance member to a surrounding member was present was checked. Plain paper having basis weight of 75 g/m$^3$ was used as the transfer material P.

The experiments were carried out also on the following comparative examples.

Comparative Example 1

In the comparative example 1, different from the configuration of Embodiment 1, the resistance member 67 was removed, and further, wiring connected to each of the conductive bearing 63 and the main body frame 80 was short-circuited outside an image forming apparatus, so that the sensor member 62 was grounded without using a resistor.

Comparative Example 2

In the comparative example 2, different from the configuration of Embodiment 1, the resistance member 67 was removed, and further, wiring connected to each of the conductive bearing 63 and the main body frame 80 was connected to a resistance unit having 1 MΩ outside the image forming apparatus. With such a configuration, the sensor member 62 was grounded through the resistance unit having 1 MΩ. Other configurations were similar to those of Embodiment 1.

Comparative Example 3

In the comparative example 3, different from the configuration of Embodiment 1, the resistance member 67 was removed, and further, wiring connected to each of the conductive bearing 63 and the main body frame 80 was connected to a resistance unit having 10 MΩ outside the image forming apparatus. With such a configuration, the sensor member 62 was grounded through the resistance unit having 10 MΩ. Other configurations were similar to those of Embodiment 1.

Comparative Example 4

In the comparative example 4, different from the configuration of Embodiment 1, the resistance member 67 was removed, and further, wiring connected to each of the conductive bearing 63 and the main body frame 80 was connected to a resistance unit having 100 MΩ outside the image forming apparatus. With such a configuration, the sensor member 62 was grounded through the resistance unit having 100 MΩ. Other configurations were similar to those of Embodiment 1.

Comparative Example 5

In the comparative example 5, different from the configuration of Embodiment 1, the resistance member 67 was removed, and further, wiring connected to each of the conductive bearing 63 and the main body frame 80 was connected to a resistance unit having 1000 MΩ outside the image forming apparatus. With such a configuration, the sensor member 62 was grounded through the resistance unit having 1000 MΩ. Other configurations were similar to those of Embodiment 1.

Comparative Example 6

In the comparative example 6, different from the configuration of Embodiment 1, the resistance member 67 was removed, and further, wiring connected to each of the conductive bearing 63 and the main body frame 80 was connected to a resistance unit having 10000 MΩ outside the image forming apparatus. With such a configuration, the sensor member 62 was grounded through the resistance unit having 10000 MΩ. Other configurations were similar to those of Embodiment 1.

Comparative Example 7

In the comparative example 7, different from the configuration of Embodiment 1, the resistance member 67 was removed, and further, wiring connected to each of the conductive bearing 63 and the main body frame 80 was connected to a resistance unit having 100000 MΩ outside the image forming apparatus. With such a configuration, the sensor member 62 was grounded through the resistance unit having 100000 MΩ. Other configurations were similar to those of Embodiment 1.

Comparative Example 8

In the comparative example 8, different from the configuration of Embodiment 1, the resistance member 67 was removed, and the sensor member 62 was not grounded. Other configurations were similar to those of Embodiment 1.

FIG. 6 indicates experiment results for the present embodiment and the comparative examples. As clear from the results indicated in FIG. 6, it is possible in the present embodiment to make the resistance between the contacts on the sensor member 62 side and the ground side of the resistance member 67 sufficiently high while using the conductive resin which has a stable resistance value as the resistance member 67. Therefore, a secondary-transfer defect associated with the leakage of the secondary transfer current to the sensor member 62 and occurrence of noise associated with the charging of the conveyance member can be simultaneously prevented, and also an inexpensive and space-saving ground configuration of the conveyance member is realized.

On the other hand, when the resistance between the sensor member 62 and the main body frame 80 is excessively low like in the comparative examples 1 to 4, the secondary transfer current leaks to the sensor member 62, so that it is not possible to prevent the secondary-transfer defect. When the resistance between the sensor member 62 and the main body frame 80 is excessively high like in the comparative examples 7 and 8, it is not possible to prevent noise which is caused when the sensor member 62 is charged by being slid on the transfer material P.

When the resistance between the sensor member 62 and the main body frame 80 is in a limited high-resistance region like in the comparative examples 5 and 6, it is possible to simultaneously prevent the secondary-transfer defect associated with the leakage of the secondary transfer current to the sensor member 62 and the occurrence of noise associated with the charging of the sensor member 62. However, because the resistance unit is used as the resistor between the sensor member 62 and the main body frame 80 as described above, excessive costs and space are required for the ground configuration in the comparative examples 5 and 6 as compared to the present embodiment.

Though the first contact portion and the second contact portion are provided at the respective ends of the resistance member 67 in the longitudinal direction in the present embodiment, the positions of the contacts on the sensor member 62 side and the ground side are not limited to the ends of the resistance member 67 in the longitudinal direction. The both contacts may be provided at positions with which a long length L of the conductive path between the contacts on the sensor member 62 side and the ground side of the resistance member 67 and a narrow width W of the conductive path are realized, and preferably the relationship L>W is satisfied. However, for obtaining a high resistance between the contacts on the sensor member 62 side and the ground side and reducing the size of the resistance member 67 more efficiently with respect to a shape of the resistance member 67, the contacts on the conveyance member side and the ground side are preferably provided at the respective ends of the resistance member 67 in the longitudinal direction.

Though the rectangular resistance member 67 is used in the present embodiment, the resistance member 67 may have any shape in which the length L of the conductive path between the contacts on the sensor member 62 side and the ground side is large and the width W of the conductive path is small.

Though the conductive resin is used as the resistance member 67 in the present embodiment, the material of the resistance member 67 is not limited to the conductive resin. For example, a magnetic material is also suitable for the material of the resistance member 67, and similar effects are able to be achieved even by using a magnetic tape, such as a video tape, obtained by covering an insulating base material with the magnetic material as the resistance member 67.

The conductive resin whose base material is polyimide is used as the resistance member 67 in the present embodiment, the base material of the conductive resin is not limited to the polyimide, and may be any resin by which conductivity is realized by adding a conductive material.

An electronically conductive resin obtained by adding carbon as the conductive material is used for the resistance member 67 in the present embodiment, the conductive material to be added to the conductive resin is not limited to the carbon. The conductive material may be a conductive filler made of metal or the like or an ion conductive material. However, the resistance of the conductive resin with certain conductive materials may greatly change depending on an environmental temperature or humidity, and therefore as the conductive material to be added to the conductive resin for use in the resistance member 67, a conductive material with which resistance of a conductive resin is not easily changed depending on an environmental temperature or humidity is preferably selected.

The resistance member 67 is made of a material that is the same as the material of the intermediate transfer belt 10 in the present embodiment. The same material as that of the intermediate transfer belt 10 can be used for the resistance member 67 from the viewpoint of reduction in costs of the resistance member 67. The resistance member 67 can be made from the material from which the intermediate transfer belt 10 is cut out, which may result in further reduction in costs.

Though the sensor member 62 is described as the member that makes contact with the transfer material P in the present embodiment, such configuration that only the conveying roller 60 and the conveyance idler roller 61 which serve as the conductive conveyance members make contact therewith may be employed.

Embodiment 2

A configuration of an image forming apparatus in the present embodiment is similar to that of Embodiment 1 except for a ground configuration of a conductive conveyance member, and thus only the ground configuration of the conductive conveyance member will be described.

Figure 7A:
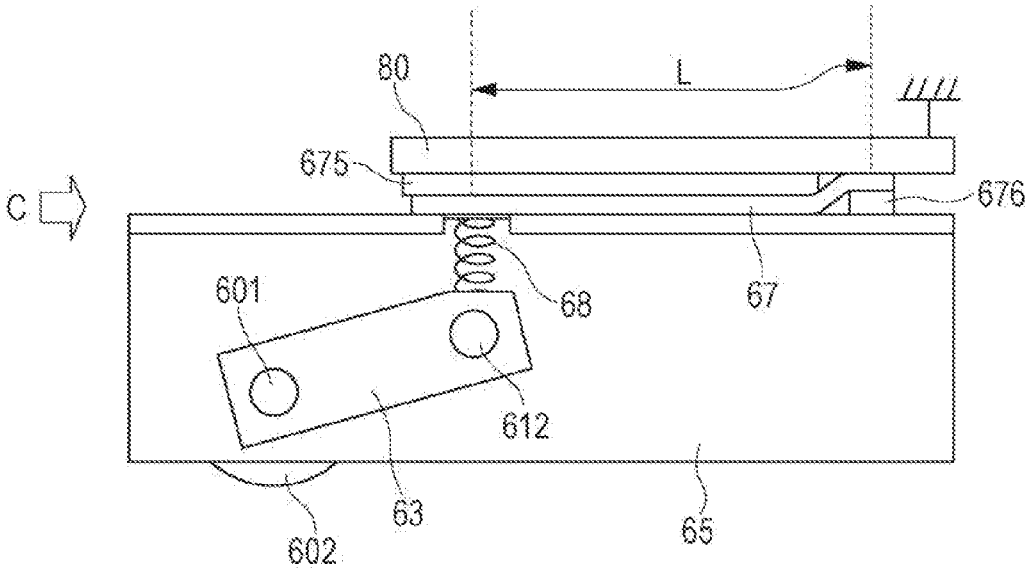
FIGS. 7A and 7B are diagrams illustrating a ground configuration of a conveyance member of Embodiment 2.
Figure 7B:
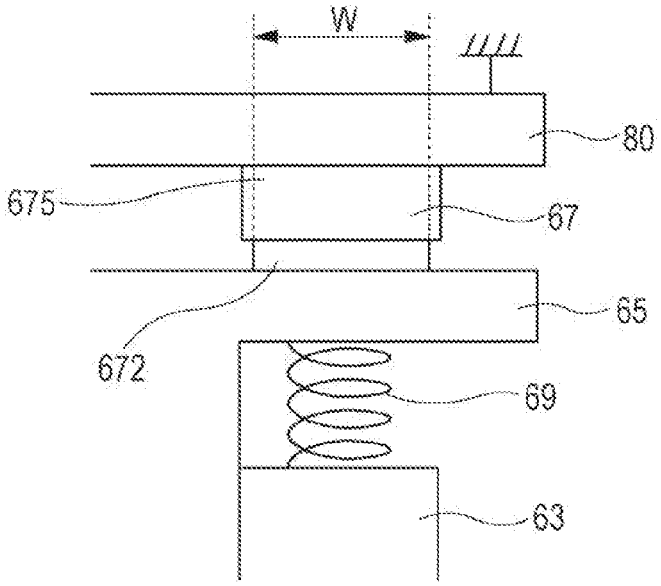

FIGS. 7A and 7B illustrate the ground configuration of the conductive conveyance member in the present embodiment, in which the conductive conveyance member is grounded through the resistance member 67 and the resistance member 67 similar to that of Embodiment 1 is used.

As illustrated in FIGS. 7A and B, the resistance member 67 is pinched and fixed between the main body frame 80 and the insulating frame 65 with a back-up member 675 made of the insulating resin in between. FIG. 7B is a diagram as viewed from a side C of FIG. 7A.

The spring member 68 serving as the first contact member is disposed between the conductive bearing 63 and the resistance member 67, and an end of the resistance member 67 in the longitudinal direction, to which the spring member 68 presses, serves as a contact on the conductive conveyance member side of the resistance member 67. An end of the resistance member 67 in the longitudinal direction, which is a side opposite to the contact on the conductive conveyance member side, is pinched and fixed between the main body frame 80 serving as the contact member on the ground side and the insulating frame 65 with a back-up member 676 made of the insulating resin in between, and thereby serves as a contact on the ground side.

Accordingly, the conductive conveyance member is configured to be grounded through the longitudinal direction of the resistance member 67, and the length L and the width W of the conductive path between the contacts on the conductive conveyance member side and the ground side of the resistance member 67 become those illustrated in FIG. 7A and FIG. 7B, respectively.

An insulating back-up member is used between the resistance member 67 and the main body frame 80 at portions other than the contact portion on the ground side of the resistance member 67 in the present embodiment. With such a configuration, an effect of preventing discharging between the resistance member 67 and the main body frame 80 at the portions other than the contact portion on the ground side of the resistance member 67 is achieved in addition to the effects of Embodiment 1.

Results obtained by carrying out the experiments for confirming the effects similarly to Embodiment 1 with the ground configuration of the conductive conveyance member in the present embodiment described above are indicated in FIG. 6. As indicated in FIG. 6, suppression of transfer defects associated with leakage of transfer current and suppression of charging of the conductive conveyance member are attained simultaneously in the present embodiment as well.

Embodiment 3

A configuration of an image forming apparatus in the present embodiment is similar to that of Embodiment 1 except for a ground configuration of a conductive conveyance member, and thus only the ground configuration of the conductive conveyance member will be described.

Figure 8A:
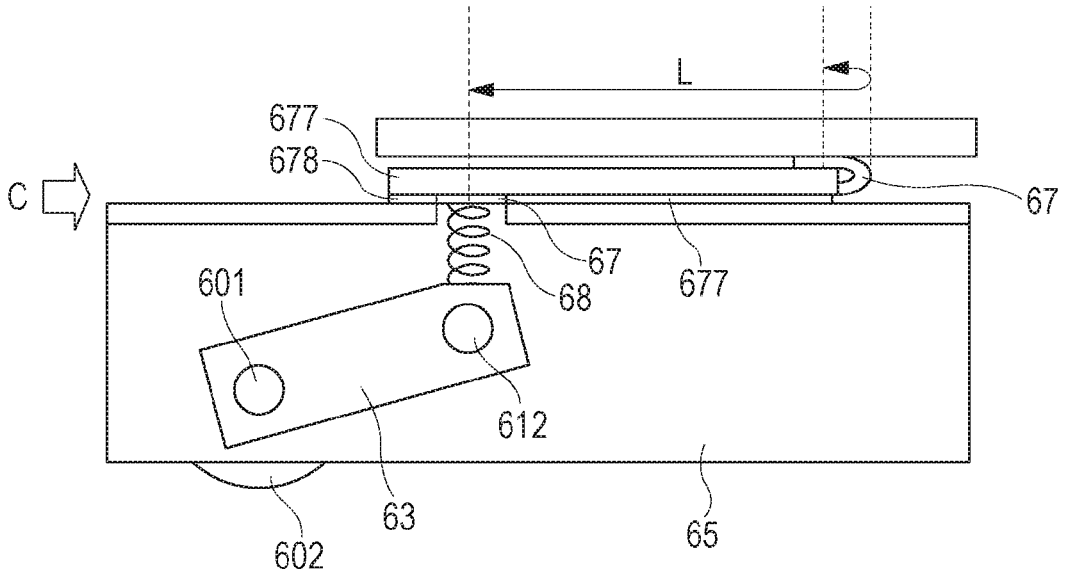
FIGS. 8A and 8B are diagrams illustrating a ground configuration of a conveyance member of Embodiment 3.
Figure 8B:
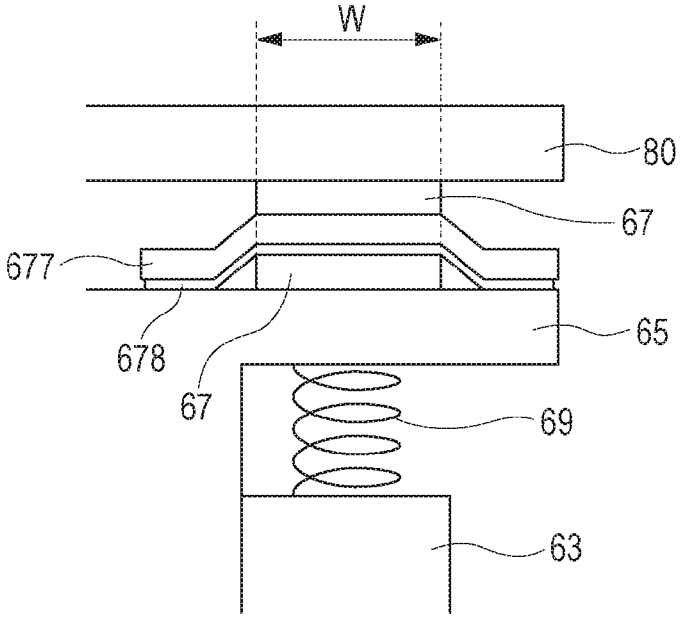

FIGS. 8A and 8B illustrate the ground configuration of the conductive conveyance member in the present embodiment, in which the conductive conveyance member is grounded through the resistance member 67 and the resistance member 67 similar to that of Embodiment 1 is used. FIG. 8B is a diagram as viewed from a side C of FIG. 8A.

As illustrated in FIGS. 8A and 8B, the resistance member 67 is attached to an insulating sheet 677 made of resin with an insulating two-sided adhesive tape 678, and further, the insulating sheet 677 is attached to the insulating frame 65 with the two-sided adhesive tape 678. The resistance member 67 is pressed to the spring member 68 at one end in the longitudinal direction, and the pressed portion serves as a contact on the conductive member side of the resistance member 67. The other end of the resistance member 67 in the longitudinal direction is bent in a thickness direction so as to pinch the insulating sheet 677. The tip end of the resistance member 67 in the longitudinal direction, which has been bent, is pinched and fixed between the main body frame 80 and the insulating frame 65 with the insulating sheet 677 in between and makes contact with the main body frame 80, and thereby serves as the contact on the ground side of the resistance member 67.

Accordingly, the conductive conveyance member is configured to be grounded through the longitudinal direction of the resistance member 67, and the length L and the width W of the conductive path between the contacts on the conductive conveyance member side and the ground side of the resistance member 67 become those illustrated in FIG. 8A and FIG. 8B, respectively.

A gap is formed between the main body frame 80 and the insulating sheet 677 so that only the contact on the ground side of the resistance member 67 makes contact with the main body frame 80 in the present embodiment, an effect that the contact on the ground side becomes more stable compared to Embodiment 2 is achieved.

Results obtained by carrying out the experiments for confirming the effects similarly to Embodiment 1 with the ground configuration of the conductive conveyance member in the present embodiment described above are indicated in FIG. 6. As indicated in FIG. 6, suppression of transfer defects associated with leakage of transfer current and suppression of charging of the conductive conveyance member are attained simultaneously in the present embodiment as well.

Embodiment 4

A configuration of an image forming apparatus in the present embodiment is similar to that of Embodiment 1 except for a ground configuration of a conductive conveyance member, and thus only the ground configuration of the conductive conveyance member will be described.

Figure 9A:
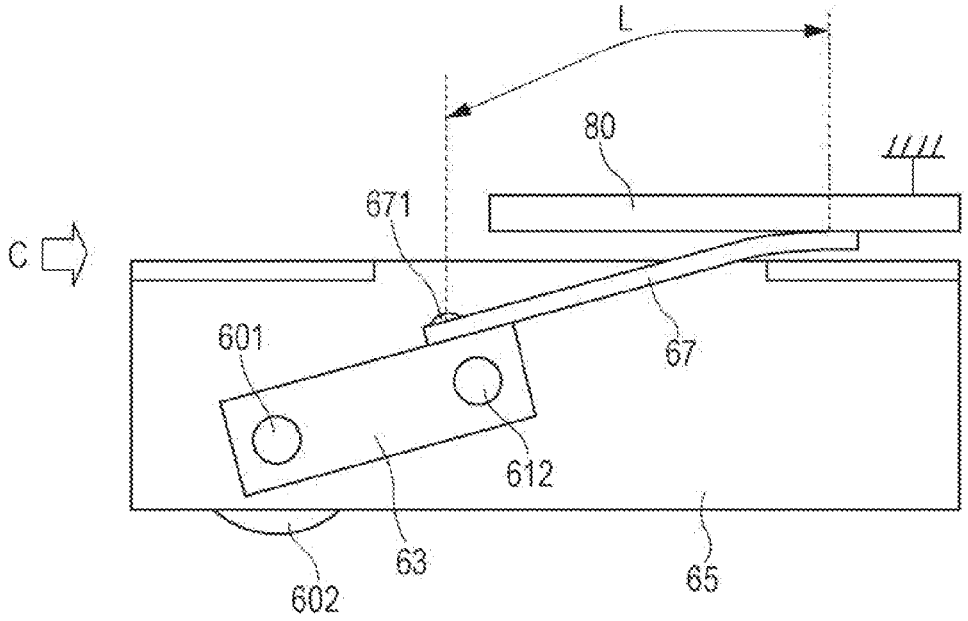
FIGS. 9A and 9B are diagrams illustrating a ground configuration of a conveyance member of Embodiment 4.
Figure 9B:
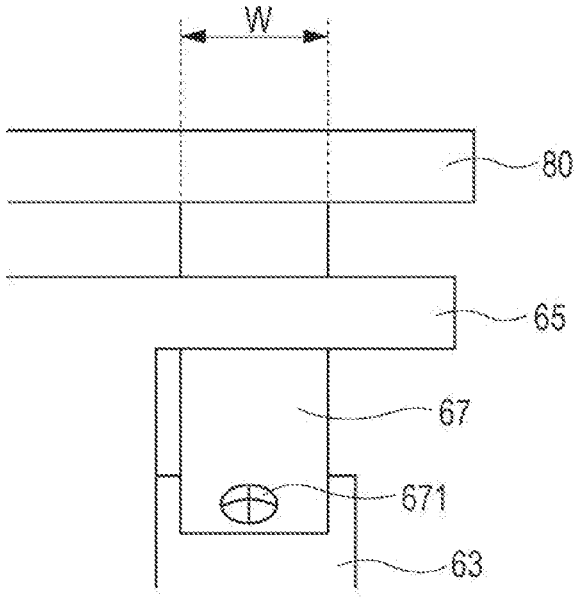

FIGS. 9A and 9B illustrate the ground configuration of the conductive conveyance member in the present embodiment, in which the conductive conveyance member is grounded through the resistance member 67 and the resistance member 67 similar to that of Embodiment 1 is used. FIG. 9B is a diagram as viewed from a side C of FIG. 9A.

As illustrated in FIGS. 9A and B, the resistance member 67 has one end in the longitudinal direction fastened by the screw member 671 together with the conductive bearing 63 serving as the contact member on the conductive conveyance member side, and the fastening portion serves as a contact on the conductive member side of the resistance member 67. The resistance member 67 is pressed to the main body frame 80 serving as the contact member on the ground side with stress caused by being bent in the thickness direction and the pressed portion serves as the contact on the ground side of the resistance member 67.

Accordingly, the conductive conveyance member is configured to be grounded through the longitudinal direction of the resistance member 67, and the length L and the width W of the conductive path between the contacts on the conductive conveyance member side and the ground side of the resistance member 67 become those illustrated in FIG. 9A and FIG. 9B, respectively.

In the present embodiment, by pressing the resistance member 67 to the main body frame 80 with the stress caused by bending the resistance member 67 in the thickness direction, the contact on the ground side of the resistance member 67 can be ensured with a simplified configuration.

Results obtained by carrying out the experiments for confirming the effects similarly to Embodiment 1 with the ground configuration of the conductive conveyance member in the present embodiment described above are indicated in FIG. 6. As indicated in FIG. 6, suppression of transfer defects associated with leakage of transfer current and suppression of charging of the conductive conveyance member are attained simultaneously in the present embodiment as well.

Other Embodiments

The pressure roller 32, the conveyance guide 22, the conveyance guide 33, and the sensor member 70 are also the conductive members which make contact with the transfer material P during secondary transfer. Thus, the ground configuration using the resistance member 67 of the present embodiments may be employed for the pressure roller 32, the conveyance guide 22, the conveyance guide 33, and the sensor member 70 as well.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-250403, filed Dec. 10, 2014, which is hereby incorporated by reference herein in its entirety.

What is claimed is:

1. An image forming apparatus comprising:

an image bearing member configured to bear a toner image thereon;

a transfer member configured to form a transfer unit with the image bearing member;

a voltage supply device configured to transfer a toner image on the image bearing member electrostatically onto a transfer material at the transfer unit by applying voltage to the transfer member;

a conductive conveyance member configured to have conductivity and make contact with the transfer material that is conveyed toward the transfer unit;

a resistor in a sheet shape configured to ground the conductive conveyance member electrically;

a first contact member configured to form a current path between the resistor and the conductive conveyance member; and a second contact member configured to form a current path between the resistor and an electrical ground portion, wherein, a first contact portion between the resistor and the first contact member and a second contact portion between the resistor and the second contact member are arranged so as not to overlap in a thickness direction of the resistor.

2. The image forming apparatus according to claim 1, wherein the relationship L>W is satisfied, where L is a length of a conductive path between the first contact portion and the second contact portion in the resistor and W is a width of the conductive path in the resistor.

3. The image forming apparatus according to claim 1, wherein a contact of the first contact portion and a contact of the second contact portion in the resistor are respective ends of the resistor.

4. The image forming apparatus according to claim 1, wherein the resistor is fastened by a screw member together with the corresponding first contact member at the first contact portion of the resistor.

5. The image forming apparatus according to claim 1, wherein the resistor is fastened by a screw member together with the corresponding second contact member at the second contact portion of the resistor.

6. The image forming apparatus according to claim 1, wherein the resistor is pressed to the first contact member or the second contact member with stress, which is caused by bending the resistor, in at least one of the first contact portion and the second contact portion of the resistor.

7. The image forming apparatus according to claim 1, wherein the image bearing member is an intermediate transfer belt onto which a toner image is primary-transferred from a photosensitive member.

8. The image forming apparatus according to claim 1, wherein the resistor is made of the material same as a material of the intermediate transfer belt.

9. The image forming apparatus according to claim 1, wherein the conductive conveyance member rotates while making contact with a transfer material that is conveyed.

10. The image forming apparatus according to claim 1, wherein the resistor is a sheet made of conductive resin.

11. The image forming apparatus according to claim 1, wherein the resistor is made of electronically conductive resin.

* * * * *